United States Patent [19]

Bührer

[11] 4,199,020

[45] Apr. 22, 1980

[54] PATTERN DEVICE FOR FOUNDRY MOLDS

[76] Inventor: Erwin Bührer, Vögelingässchen 40, CH 8200Schaffhausen, Switzerland

[21] Appl. No.: 955,345

[22] Filed: Oct. 27, 1978

[30] Foreign Application Priority Data

Oct. 31, 1977 [CH] Switzerland ..... 13199/77

[51] Int. Cl.[2] ..... B22C 7/04

[52] U.S. Cl. ..... 164/146; 164/213; 164/241

[58] Field of Search ..... 164/146, 188, 213, 217, 164/226, 253, 239, 241; 425/437; 249/66 A

[56] References Cited

U.S. PATENT DOCUMENTS

| | | | |
|---|---|---|---|
| 195,070 | 9/1877 | Aikin et al. | 164/188 |
| 2,672,664 | 3/1954 | Sudziarski | 164/146 |
| 3,587,144 | 6/1971 | Mechling | 425/437 X |

FOREIGN PATENT DOCUMENTS

| | | | |
|---|---|---|---|
| 592741 | 2/1960 | Canada | 164/241 |
| 348970 | 2/1922 | Fed. Rep. of Germany | 164/226 |
| 431786 | 7/1926 | Fed. Rep. of Germany | 164/226 |
| 391975 | 9/1908 | France | 164/226 |

*Primary Examiner*—Robert D. Baldwin

*Attorney, Agent, or Firm*—Toren, McGeady and Stanger

[57] ABSTRACT

Mold forming apparatus including a pattern device which is composed of pattern plates adapted to be operatively fitted into a pattern plate carrier is operated with the pattern device shifted between a lifting station, at which a formed mold may be removed from the patterns of the pattern plates, and an exchange station where the pattern plates may be separated from the pattern plate carrier for appropriate treatment thereof. The pattern plate carrier is formed in a generally box-like configuration with a bottom member having openings extending therethrough through which extraction pins of a lifting device may extend in order to raise and lower the pattern plates from the pattern plate carrier at the exchange station. A vacuum system is provided which will tend to hold the pattern plate carrier upon a bearing member of the apparatus and which will also tend to hold the pattern plate upon the pattern plate carrier while the finished mold is removed therefrom. An additional compressed air system operates to introduce air at the interface between the molds and the pattern plates in order to facilitate the separation thereof.

7 Claims, 7 Drawing Figures

38
102
100
98
C
100
102
136
114
134
110
40
132
50
54
154
144
147
104
46
48
34
44
42
140
156
150
138
52
56
18
122
126
130
98
128
124
26
138
20
116
120
118
147
156
150
144
148
146
145
86
IV
60

48
152
140
34
154
88
142
145
143
30
18
60
30
56
62
56
140
52
104
IV
98
20

PATTERN DEVICE FOR FOUNDRY MOLDS

BACKGROUND OF THE INVENTION

The present invention relates generally to mold forming apparatus and more specifically to the structure and arrangement of a pattern device useful in the formation of foundry molds. The pattern device of the invention is of the type which can be moved from a lifting station, where formed mold halves may be lifted from the pattern plates, to a pattern plate exchange station.

Pattern devices for utilization in the formation of foundry molds are known. Such pattern devices combine a frame structure, arranged as a pattern plate centering device, with pattern plates in order to form a unit and in order to connect the frame to a molding table. In order to perform an exchange of the pattern plates of these pattern devices, at least one lifting unit is provided at the molding table. The lifting unit lifts the pattern plates while in a loose state out of a frame to an extent sufficient to enable the pattern plates to be grasped laterally so that an exchange may be effected.

Since, in pattern devices of this type, due to the manner in which the devices are arranged, the pattern plates can be lifted only to a limited height, the molding sand which falls onto the molding table of the apparatus cannot be removed. As a result, this causes the pattern plates to be oriented in a higher position than is desired thereby preventing a satisfactory closing or joinder of the sand between the lower and upper parts of the apparatus.

A further disadvantage resides in the fact that the pattern plate exchange procedure will result in long plates arranged in a pattern plate carrier. The pattern plates are pressed with their stop faces against stop faces which are part of the pattern plate carrier. Such centering devices utilize a piston-cylinder unit used as a pressure transmitting means for vertical centering of a pattern plate. The centering device has a plate shaped cylindrical part which acts through intermediate plates on the pattern plate and which is provided with cylinder bores which are connected to each other through several transfer ducts. Arranged in these cylinder bores are piston bodies which are supported by the bottom of the pattern plate carrier. When connected to an energy source, the centering device presses the pattern plate with the stop face against the bolt heads of setbolts which are passed through the pattern plates, the intermediate plates and the cylinder parts and which are screwed into the bottom of the pattern plate carrier.

This centering device also has the disadvantage that the molding sand cannot be removed from inside of the cup shaped pattern carrier during pattern plate exchange without requiring disassembly not only of the pattern plates but additionally all other parts in the pattern carrier. Furthermore, the centering device had the disadvantage that, due to the piston-cylinder unit, the structural height as well as the weight are doubled considered in relationship to comparable pattern devices. A further disadvantage resides in the fact that precision setbolts must be screwed out and back during each pattern exchange. A still further disadvantage resides in the fact that bolt heads as well as dividing walls involved tend to reduce the utilization factor of the pattern surface with respect to the pattern lining. With regard to an example of prior art such as that discussed above, reference is made to German Offenlegungsschrift No. 1,808,493.

The present invention is directed to the task of eliminating the disadvantages of the prior art discussed above.

SUMMARY OF THE INVENTION

The task sought to be accomplished by the invention is achieved in that the pattern plates involved are rigidly supported on the bottom of a pattern plate carrier and that, furthermore, openings are provided in the bottom member of the pattern plate carrier so that a lifting device located at a pattern plate exchange station may be arranged exteriorally of the pattern device in order to enable a plurality of extractor pins forming part of the lifting device to be directed toward the openings in the bottom of the pattern plate carrier and to extend therethrough into engagement with the pattern plates at the pattern plate exchange station.

As a result of the organization of the invention, the lifting device is capable of lifting the pattern plates through a total height extending out of the pattern plate carrier in view of the fact that the pattern plate carrier is formed with openings in the bottom part thereof. As a result, molding sand may be removed quickly and completely from the pattern plate carrier during the pattern plate exchange operation. Furthermore, since the pattern plates are supported directly on the bottom of the pattern plate carrier, the constructional height and weight of the pattern device may be minimized.

By an especially advantageous aspect of the invention, the bottom of the pattern plate carrier may be provided with sealing elements on the lower and upper side of the carrier bottom so that a sealed vacuum chamber may be created within the volume defined by the openings. A bearing member acting against the lower side of the bottom member of the pattern plate carrier is formed with a controllable vacuum line directed to the openings in the bottom of the pattern plate carrier. The upper side of the pattern plate carrier bottom member may have the pattern plates themselves bearing thereagainst and as a result of a vacuum force created it becomes unnecessary to utilize bolts which must be screwed and unscrewed during a pattern plate exchange operation.

A further advantageous embodiment of the invention involves the utilization of ducts extending through the bottom of the pattern plate carrier, through an intermediate layer and through the pattern plates themselves, with the ducts opening into the upper surface of the patterns so that a controlled compressed air line may provide a separation force at the bearing area between the patterns and the formed mold.

As a result, the lifting of mold halves from the pattern, particularly mold halves out of a pattern pocket, may be significantly facilitated.

A further advantageous embodiment of the invention resides in the use of extractor pins of the lifting device which are constructed with conically shaped upper ends which engage within depressions provided on the bottom side of the pattern plates or upon intermediate layers which may be alternatively utilized in order to facilitate the lifting and lowering operation of the pattern plates.

As a result, the pattern plates, or the alternatively utilized intermediate layers, lifted out of the pattern plate carrier are preliminarily centered whereby the pattern plate exchange is rendered easier with the time required for the exchange operation being shortened.

By further embodiment of the invention, magnets which hold the pattern plates may be provided at the upper side of the intermediate layers which are located between the bottom of the pattern plate carrier and the pattern plates. As a result, it will be unnecessary to fasten the pattern plates which rest upon the intermediate layers by means of screws or the like.

Another advantageous embodiment of the invention involves the fact that the pressing device which is utilized includes a pretension spring which is capable of pressing the pattern plates against the stop faces of the pattern plate carrier. As a result, the pattern devices with the pressing devices which are in service do not require supply lines for a pressure medium.

A further advantageous embodiment of the invention involves the utilization of a lever for the pressing device through which the pattern plates may be pressed against the stop faces of the pattern carrier. As a result, pattern plates having a relatively small thickness dimension can also be satisfactorily pressed against stop faces of the pattern plate carrier.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
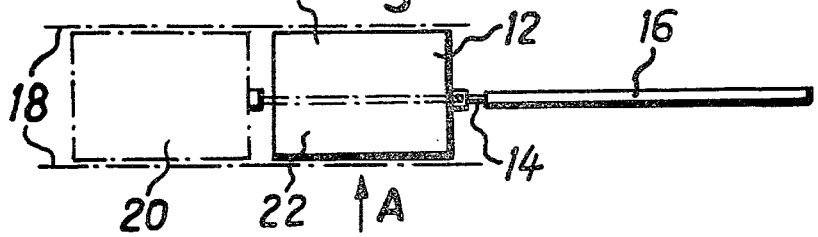
FIG. 1 is a schematic plan view of apparatus utilizing an embodiment of the invention.
Figure 2:
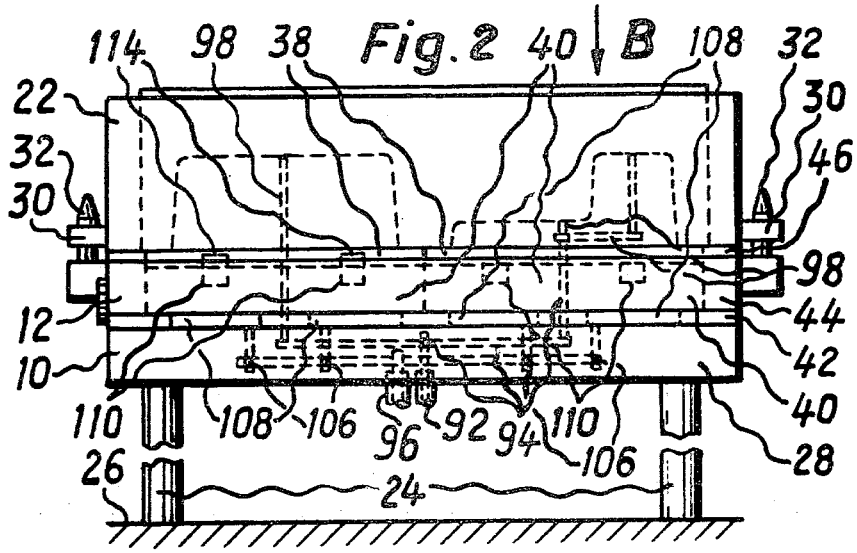
FIG. 2 is an elevational view taken at the lifting station of the apparatus in a direction indicated by the Arrow A of FIG. 1 wherein a roller table is not shown.
Figure 3:
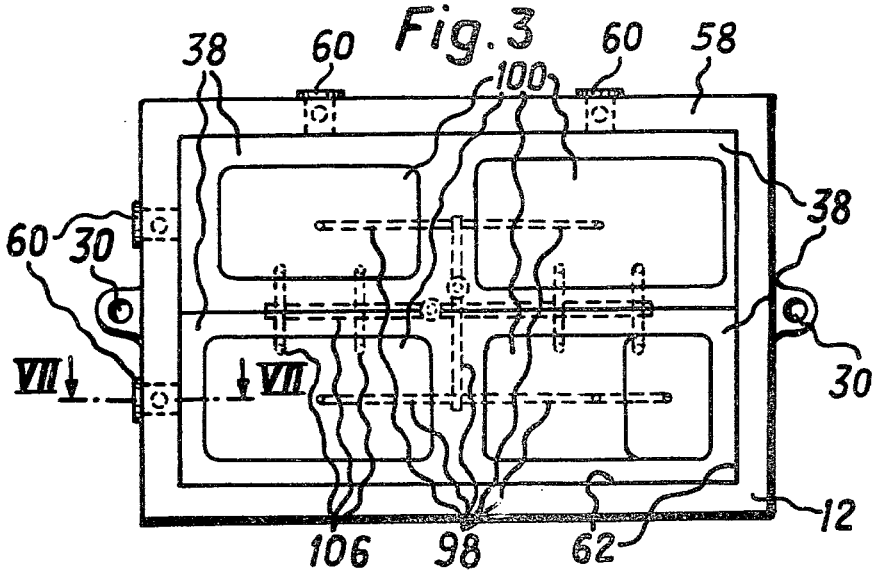
FIG. 3 is a top view of FIG. 2 taken in the direction of the arrow B without the mold half.
Figures 4, 5:
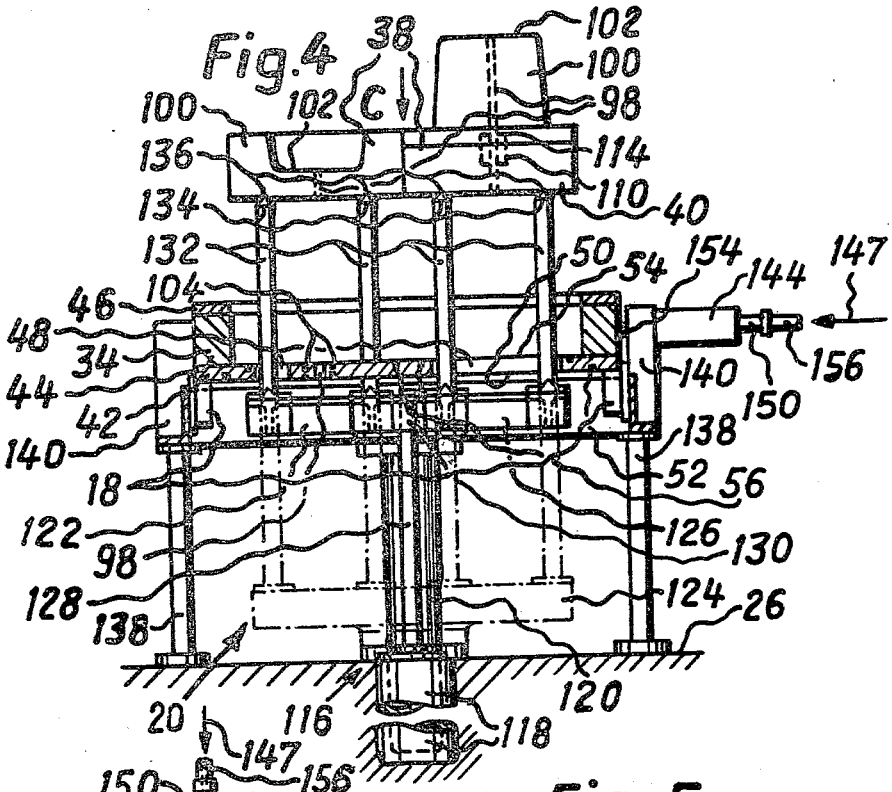
FIG. 4 is an elevational view partially in section, showing a pattern plate exchange station with the pattern plate carrier, taken along the line IV—IV of FIG. 5.
FIG. 5 is a top view of FIG. 4 taken in the direction of the arrow C, without the pattern plates and lifting device.

Referring now to the drawings, wherein like reference numerals are used to refer to similar parts throughout the various figures thereof, there is shown in FIG. 1 a schematic representation of the apparatus embodying the invention wherein there is defined a mold separation station 10 in which there is arranged a pattern device 12. By means of a cylinder 16 and a piston rod 14 the pattern device 12 can be moved over a roller conveyer 18 into a pattern plate exchange station 20 and back to the mold separation station 10. For purposes of clarity, the mold separation station 10 is shown in FIG. 2 without the roller conveyor 18 and in FIG. 3 without the mold half 22. The mold separation station 10 includes columns 24 which are supported on a ground location 26. A bearing member 28 carries the pattern device 12 upon which a mold half 22 is supported. The mold half 22 is centered by dowel guides 30 within dowels 32. The pattern device 12 consists of a pattern plate carrier 34 having a bottom member 42 upon which pattern plates 38 are supported either directly thereupon, or alternatively through an intermediate layer 40, which may be utilized in order to compensate for the thickness of the pattern plates 38 (FIG. 4).

The pattern plate carrier 34 comprises the bottom member 42, a frame member 44 and a frame plate 46 which are rigidly connected with each other. Openings 48 are provided to extend through the bottom 42 of the pattern plate carrier 34. Formed on the lower side 50 of the bottom member 42 are sealing elements 52 which extend about each of the openings 48 in the bottom member 42. Formed on the upper side 54 of the bottom member 42 are several similar sealing elements 56 which also extend about the openings 48 and which are adjusted to the smallest size of the pattern plates 38 which are to be placed upon the bottom member 42. Arranged within the frame 44 at two sides 58 which form an angle there are provided pressing devices 60 by means of which the pattern plates 38 can be pressed against stop faces 62 of the carrier 34.

Figure 7:
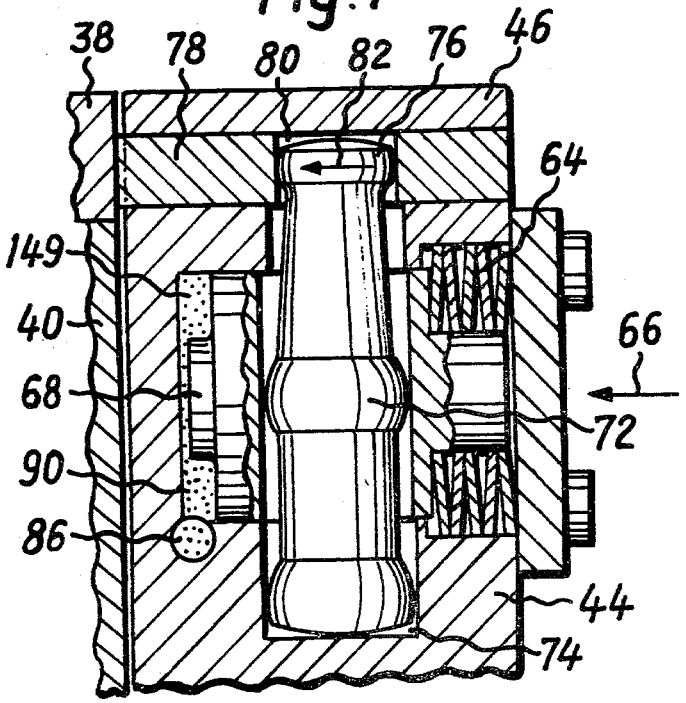
FIG. 7 is a view partially in section taken along the line VII—VII of FIG. 3 showing a pressing device on an enlarged scale.

One of the pressing devices 60 is shown in greater detail in FIG. 7. Pretensioned cup springs 64 exert a spring force in the direction of arrow 66 against a piston 68 which transmits the pressure to a bolt 72 constructed in the form of a one-armed lever. Since the bolt 72 is supported in a bore 74 in the frame 44, the pressure is also transmitted through a lever part 76 of a sliding member 78 having a bore 80 engaged by the lever part 76. As a result, the lever part 76 is moved in the direction of an arrow 82 and presses the pattern plates 38 against corresponding stop faces 62. The use of a pretensioned spring 64 for pressing the pattern plates 38 eliminates the necessity for connection of the pattern device 12 to a pressure line during operation. Moreover, ducts 86 are provided in the frame 44 which ducts 86 connect a connecting opening 88 with a space 90 of all the pressing devices 60.

During lifting of a mold half 22, a controlled compressed airline 92 operates to introduce compressed air between a surface 102 of patterns 100 and the surfaces of the mold halves 22. The compressed air flows through ducts 94 in the bearing member 28 and through ducts 90 in the bottom member 42. Furthermore, airflow extends through the intermediate layers 40, where utilized, and through the pattern plates 38. An undesired escape of compressed air at the lower side 50 and at the upper side 54 of the bottom member 42 is prevented by sealing elements 104 in the bottom member 42 of the pattern plate carrier 34.

When the pattern device 12 rests upon the bearing member 28, another line 96 provided in the bearing member 28 is switched to supply a vacuum which is connected through ducts 106 to the hollow spaces 108 formed by the openings 48 in the bottom member 42. Since the sealing elements 52, 56 seal the hollow spaces 108 on both sides thereof, a vacuum may be drawn in the hollow spaces 108 by appropriate switching or reversing of the line 96. As a result, when the mold halves 22 are lifted from the pattern plates 38, the plates 38 will be held in the pattern plate carrier 34 and the pattern plate carrier 34 will be held upon the bearing member 28. Thus, lifting of the mold halves 22 from the pattern plates 38 is facilitated. This is particularly advantageous when mold halves which have been compacted to a high pressure are to be lifted from the patterns 100 of the pattern plates 38 where the patterns have large vertical surfaces. Magnets 110 which are mounted at the upper side of the intermediate layers 40 operate to hold the pattern plates 38 supported upon the intermediate layers 40 during lifting of the mold halves 22. In a case where the pattern plates 38 are made of a nonmagnetic material, magnetic inserts 114 are placed at those areas of the pattern plates 38 which are located adjacent the magnets 110 in order to enable the formation of a magnetic force in the manner indicated.

Figure 6:
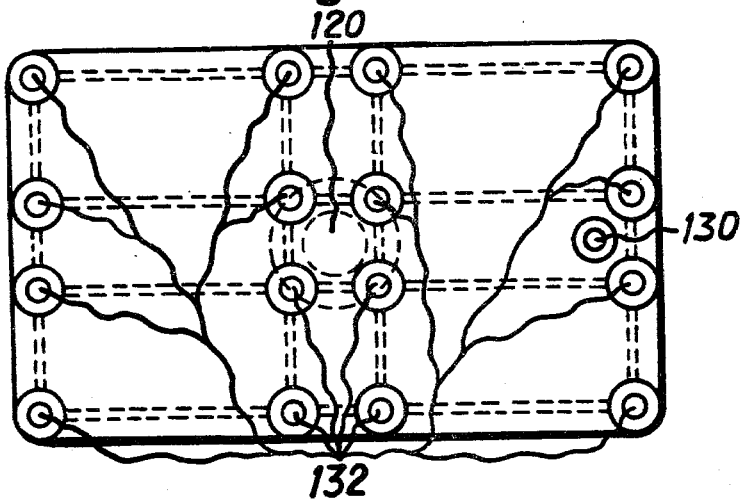
FIG. 6 is a top view of the lifting device taken in the direction of the arrow C of FIG. 4.

The pattern plate exchange station 20 is shown in greater detail in FIG. 4. For the sake of clarity, the pattern plate carrier 34 is shown in section, with the sectional view thereof being taken along the line IV—IV of FIG. 5. Located at the exchange station 20 is a lifting device 116 which is composed of a piston 120 and a cylinder 118, the lifting device 116 being mounted upon the ground 26. The piston 120 carries a table 122 which can be moved from a lowered position 124 into an elevated or raised position 126. A guide rod 128 fastened onto the ground 26 engages a bore 130 of the table 122 and secures the table 122 against rotation. In the table 122 there are arranged extraction pins 132 which are constructed with a conical configuration at their upper ends 134 (see also FIG. 6). When the table 122 is raised from the lower position 124, the upper ends 134 of the extraction pins 132 engage depressions 136 formed on the lower side of the pattern plates 138, or formed on the bottom of the intermediate layers 40, with this engagement operating to center the pattern plates 38 in the raised positions until the table 122 is again in the lowered position 124.

Columns 138 which carry the roller conveyer 18 simultaneously operate to support a clamping stirrup 140 in which the pattern device 12 may be fixed in the pattern plate exchange station 20. A valve 142 located to be switched by the pattern device 12 supplies compressed air to a cylinder 144 through a line 145 thereby to effect movement of a piston 146 in the direction of an arrow 147. The piston 146 has a piston rod 150 which projects from the cylinder 146 on both sides thereof and which includes a through bore 148. When the valve 142 is again switched to an exhaust position, a helical spring 152 presses against the piston 146 and the piston rod 150 and moves these elements back into their initial position thereby releasing the pattern plate carrier 34. The end of the piston rod 150 facing away from the pattern plate carrier 34 is connected to a controlled line 156 which is filled with grease. Through a reversible valve (not shown) the grease 149 may be pressurized, with the space 90, the ducts 86 and the bore 148 also being filled with the grease 149.

The lifting of the mold halves 22 will be described insofar as this procedure is related to the functions of the pattern device 12. As indicated in FIG. 2, the pattern device 12 is supported by the bearing member 28 and placed on the pattern device 12 is a mold half 22 which is in a condition ready to be lifted therefrom. The line 96 and the hollow spaces represented by the ducts 106 are switched to a vacuum condition whereby the pattern plates 38 will be held in the pattern plate carrier 34, with the pattern plate carrier 34 being, in turn, held on the bearing member 28. Simultaneously, through the pressure line 92 and through the ducts 94, 98, compressed air is supplied in the manner previously described to the surface 102 of the patterns 100 whereby there is caused to occur a pressure increase along the contact surfaces between the patterns 100 and the mold half 22. When the mold half 22 is lifted from the pattern device 12, in a manner known in the art, no fastening elements will be required for holding the pattern device 12 and the pattern plates 38 upon the bearing member 28. Due to the pressure increase at the contact surfaces between the molding sand of the mold halves 22 and the surfaces 102 of the patterns 100, lifting of the mold halves 22 is significantly facilitated, particularly when the mold halves have sand bales.

When all of the mold halves 22 which are to be formed in a particular pattern device 12 which is in operation have been completed, the pattern device 12 is coupled to a piston rod 14 and the valves 92, 96 are switched to exhaust, with the roller conveyer 18 being raised and with the pattern device 12 being moved into the pattern plate exchange station 20 by reversal of the cylinder 16. Upon reaching the pattern plate exchange station 20, the pattern device 12 operates to open the valve 142 above the pins 143 whereby compressed air is supplied to the cylinder 144, and the piston rod 150 is moved in the direction of arrow 147 with the end 154 of the piston rod being joined to the connecting opening 88. By means of a controlled sequence involving, for example, interposing time switches, the grease 149 will be now pressurized through the line 156, and the piston 68 will be moved against the direction of the arrow 66 or, respectively, the slide member 78 will be moved against the direction of the arrow 82 whereby the pattern plates 38 will be unstressed. Subsequently, the lifting device 116 is reversed in the same manner for raising the table 122 from the position 124 into the position 126, and the pattern plates 38 or the intermediate layers 40 will be lifted out of the pattern plate carrier 34 (FIG. 4). All of these procedures will occur automatically and at a relatively quick pace. The subsequent cleaning of the pattern devices 12 may occur quickly and without difficulty since the pattern plates 38 may be lifted a significant distance above the pattern plate carrier 34 and since the bottom member 42 of the carrier 34 is provided with a plurality of relatively large openings 48.

As a result of the centering of the raised pattern plates 38, or of the intermediate layers 40, the subsequent exchange of individual or plural pattern plates will be simplified. The pattern plate exchange is followed by an automatic assembly of the pattern device 12. By reversing the lifting device 116, the table 122 is lowered from the position 126 into the position 124 and, by means of a control sequence, the grease 149 is again pressurized whereby the cup springs 64 move the piston 68 in the direction of arrow 66 and again press the pattern plates 38 against the stop faces 62 in the manner previously described. In so doing, a portion of the grease 149 is pressed through the ducts 86, 88 and the bore 148 into the line 156. Subsequently, the cylinder 144 is reversed through the valve 142, the piston 150 moves against the direction of the arrow 147 and, thus, the pattern device 12 which is in the clamping stirrup 140 is released. By reversing the cylinder 16, the pattern device 12 may be moved into the mold separation station 10. In the lifting station 10, the roller table 18 is lowered, the piston rod 14 is uncoupled, and thus the working cycle is concluded.

From the foregoing it will be apparent that the present invention makes it possible to partially or entirely exchange within a very short time a pattern device which consists of partial pattern plates. The partial pattern plates can have a very simple design and may therefore be relatively inexpensive. As a result, the present invention provides the possibility of producing pattern plates of various shapes which may be molded in small specified sizes on devices designed for larger scale orders thereby enabling their productivity to be increased.

While specific embodiments of the invention have been shown and described in detail to illustrate the application of the inventive principles, it will be understood that the invention may be embodied otherwise without departing from such principles.

What is claimed is:

1. Mold forming apparatus comprising pattern means adapted to have a mold portion formed thereon; carrier means upon which said pattern means are supported; means defining a mold separation station including means for separating a formed mold portion from said pattern means; means defining a pattern means exchange station; transfer means for moving said pattern means and said carrier means between said mold separation station and said exchange station; lifting means including a plurality of extraction pins located at said exchange station for moving said pattern means relative to said carrier means; said carrier means being formed with a bottom member upon which said pattern means is supported; and means defining openings through said bottom member of said carrier means; said extractor pins extending through said openings in said bottom member to engage said pattern means to effect lifting and lowering of said pattern means upon actuation of said lifting means.

2. Apparatus according to claim 1 further comprising a bearing member upon which said bottom member is engaged to support said carrier means, sealing elements extending about said openings on the upper side and on the lower side of said bottom member, with said sealing elements on the upper side of said bottom member being engaged by said pattern means and with said sealing elements on the lower side of said bottom member being engaged by said bearing member, and means for applying a vacuum within the volume defined by said openings in said bottom member thereby to hold said pattern means against said bottom member and to hold said bottom member against said bearing member.

3. Apparatus according to claim 1 including compressed air means extending through said pattern means to apply a compressed air force at the surface of said pattern means to facilitate separation therefrom of a mold portion formed thereon.

4. Apparatus according to claim 1 wherein said extractor pins are formed with conically configured upper ends and wherein said pattern means are provided with downwardly opening depressions formed to have said conical upper ends of said extractor pins engage therein.

5. Apparatus according to claim 1 comprising magnet means interposed between said carrier means and said pattern means for providing a magnetic force tending to hold said pattern means on said carrier means.

6. Apparatus according to claim 1 wherein said carrier means are provided with stop faces adapted to have said pattern means pressed into abutting relationship thereagainst, said apparatus further comprising pressing devices including pretensioned spring means for pressing said pattern means against said stop faces.

7. Apparatus according to claim 6 wherein said pressing devices include lever means through which said pattern means are pressed against said stop faces of said carrier means.

* * * * *